United States Patent [19]

Makimoto et al.

[11] 4,371,853

[45] Feb. 1, 1983

[54] STRIP-LINE RESONATOR AND A BAND PASS FILTER HAVING THE SAME

[75] Inventors: Mitsuo Makimoto, Yokohama; Sadahiko Yamashita, Sagamihara, both of Japan

[73] Assignee: Matsushita Electric Industrial Company, Limited, Japan

[21] Appl. No.: 201,541

[22] Filed: Oct. 29, 1980

[30] Foreign Application Priority Data

Oct. 30, 1979 [JP] Japan ..... 54-140958
Dec. 17, 1979 [JP] Japan ..... 54-164428

[51] Int. Cl.[3] ..... H01P 1/203; H01P 1/212; H01P 7/08

[52] U.S. Cl. ..... 333/204; 333/219

[58] Field of Search ..... 333/202-212, 333/218-233, 245-246

[56] References Cited

U.S. PATENT DOCUMENTS 2,411,555 11/1946 Rogers ..... 333/202
4,233,579 11/1980 Carlson et al. ..... 333/204
4,313,097 1/1982 De Ronde ..... 333/204

*Primary Examiner*—Marvin L. Nussbaum
*Attorney, Agent, or Firm*—Lowe, King, Price & Becker

[57] ABSTRACT

The width of a strip-line conductor in a TEM mode resonator is made wider at the center portion thereof, at which current is maximum, then the open-ended widths at both end portions of the conductor so that impedance of the center portion is lower than the impedances of both end portions. The impedance may be stepwisely or continuously varied, and spurious resonance frequencies may be determined by the impedance ratio between the higher and lower impedances. Such a resonator may be included in a band pass filter in such a manner that the band pass filter comprises at least one resonator whose spurious resonance frequencies differ from those of remaining resonators.

18 Claims, 14 Drawing Figures

STRIP-LINE RESONATOR AND A BAND PASS FILTER HAVING THE SAME

FIELD OF THE INVENTION

This invention generally relates to a strip-line resonator and to a band pass filter having strip-line resonators. More particularly, the present invention relates to a microwave integrated circuit comprising such a resonator and/or a band pass filter.

BACKGROUND OF THE INVENTION

As a TEM mode transmission line type resonator for a filter for high frequencies of VHF and SHF bands, a distributed constant half wave or quarter wave line has typically been used hitherto. A flat coaxial transmission line, a strip line or a microwave stripline is used as a transmission line, and the resonance frequency is determined only by the length of the line, while the resonance frequency is not related to the line impedance.

FIGS. 1A and 1B illustrate a top plan view and a cross-sectional view of a conventional half wave open-ended resonator used in a microwave integrated circuit. This resonator is manufactured by forming a ground-plane conductor 13 on one surface of a dielectric substrate 13 and a narrow conductor 11 on the other surface of the substrate 13. The impedance of the line is usually set to 50 ohms in order to readily provide impedance matching with respect to external circuits. The resonator of FIGS. 1A and 1B has a characteristic such that the width of the conductor or line 11 narrows as the dielectric constant of the substrate 12 increases if the thickness of the substrate 12 is kept constant. For instance, assuming that the substrate 12 thickness is 1.0 millimeter, the width expressed in terms of W equals 2.6 millimeters when the dielectric constant is 2.6, and W equals 1.0 millimeter when the dielectric constant is 9. Because the resistance per unit distance increases as the width W decreases, the Q of the resonator deteriorates due to the resistance loss.

Assuming the length of the double open-ended strip-line of FIGS. 1A and 1B is expressed in terms of l, the resonance frequency f is given by:

$$f = \frac{n}{2}\left(\frac{v_g}{l}\right)$$

wherein n is 1, 2, 3 . . . and $v_g$ is the velocity of an electromagnetic wave which propagates along the transmission line.

The lowest resonance frequency is referred to as the fundamental resonance frequency and is expressed as $f_0$. There exist innumerable resonance frequencies as indicated by the above formula, and the resonance frequencies other than the fundamental resonance frequency $f_0$ are referred to as spurious resonance frequencies. The lowest spurious resonance frequency and the second lowest spurious resonance frequency are respectively expressed in terms of $f_{s1}$ and $f_{s2}$, and these $f_{s1}$ and $f_{s2}$ are given by:

$$f_{s1} = \frac{2}{2}\left(\frac{v_g}{l}\right) = 2f_0$$

-continued $$f_{s2} = \frac{3}{2}\left(\frac{v_g}{l}\right) = 3f_0$$

The above equations indicate that the spurious resonance frequencies equal the integral multiples of the fundamental resonance frequency $f_0$. Therefore, if a resonator of this structure of FIGS. 1A and 1B is used in an output filter of an oscillator or the like, harmonics of the second, third and more orders can not be suppressed.

As an example of another conventional strip-line resonator, which has a harmonic-suppression characteristic, a resonator having a structure shown in FIG. 2 is known. This resonator has a structure such that the impedance at the center portion 52 of the half wave resonator is made higher, while the impedances at the both end portions 51 and 53 are made lower. Namely, the resonator has a structure such that the width W1 of the center portion 52 is made narrower than the width W2 of the tip portions 51 and 53. With this structure, it is possible to make the spurious resonance frequency equal a value which is over twice the fundamental frequency $f_0$. However, since the width of the center portion of the line 11, at which the electric current is maximum, is narrow, the resonator of this structure has a drawback in that the loss therein is greater than that of a uniform-width resonator having a constant width throughout the entire line.

When the aforementioned conventional resonator of FIGS. 1A and 1B having a uniform-width line is used to construct a band pass filter, the filtering or attenuating characteristic of the band pass filter as shown in FIG. 3 will be shown by the graphical representation of FIG. 4. Namely, there are dips in the attenuation curve at the fundamental frequency, $f_0$, twice the fundamental frequency $2f_0$, three times the fundamental frequency $3f_0$ and so on. Therefore, when such a conventional band pass filter constructed of a plurality of uniform-width lines is used in a device, such as a wide-band receiver, a spectrum analyser or the like, in which only a desired signal should be transmitted while suppressing or attenuating other signals to a sufficient level, extra filter(s) such as band stop filters for rejecting the frequency components of $2f_0$, $3f_0$ and so on, or a low pass filter for permitting the transmission of only the fundamental frequency component $f_0$ is/are required.

SUMMARY OF THE INVENTION

The present invention has been developed in order to remove the above-mentioned disadvantages and drawbacks inherent to the conventional strip-line resonator and to the conventional band pass filter constructed of strip-line resonators.

It is, therefore, a primary object of the present invention to provide a new and useful strip-line resonator in which spurious resonance is greatly suppressed.

Another object of the present invention is to provide a new and useful band pass filter having strip-line resonators, in which the band pass filter rejection characteristic with respect to integral multiples of the fundamental frequency has been remarkably improved.

A further object of the present invention is to provide such a strip-line resonator and/or such a band pass filter in which the resistance loss has been considerably reduced compared to conventional devices.

In order to achieve the abve-mentioned objects, the width of a strip-line conductor in a TEM mode resonator is made wider at the center portion thereof, at which the current is maximum, than the widths of both open-ended end portions of the strip-line conductor. As a result, the impedance of the center portion is lower than the impedances of both end portions thereby reducing the electrical power loss, while spurious resonance frequencies do not equal the integral multiples of the fundamental resonance frequency. Moreover, such a strip-line resonator is used to form a band pass filter with other resonators. Among a plurality of resonators included in a band pass filter, at least one resonator has spurious resonance frequencies different from those of the remaining resonators. Therefore, the band pass filter selectively transmits only the fundamental resonance frequency signal.

BRIEF DESCRIPTION OF THE DRAWINGS

These and other objects and features of the present invention will be more readily apparent from the following detailed description of the preferred embodiments taken in conjunction with the accompanying drawings in which.

DETAILED DESCRIPTION OF THE PREFERRED EMBODIMENTS

Figure 5A:
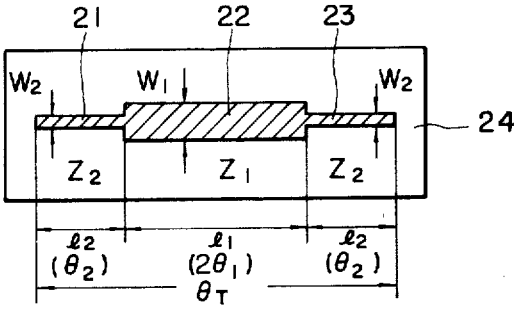
FIGS. 5A and 5B are a schematic top plan view and a cross sectional view of an embodiment of the strip-line resonator according to the present invention.
Figure 5B:
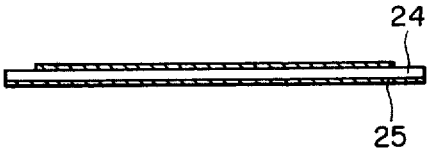

Reference is now made to FIGS. 5A and 5B which show a top plan view of an embodiment of the strip-line resonator according to the present invention and a cross-sectional view of the same.

The strip-line resonator comprises a substrate 24 made of a dielectric, a ground-plane conductor 25, and a conductor pattern having strip lines 21, 22 and 23. The strip lines 21 to 23 are attached to one surface of the substrate 24, while the ground-plane conductor 25 is attached to the other surface of the substrate 24. The strip lines 21 to 23 are integrally formed, and are aligned in a series connection in the shape of a straight line. Each of the strip lines 21 and 23 has an open end so that the remaining strip line 22 is interposed between these two strip lines 21 and 23. Each of these strip lines 21 and 23 at the ends of the resonator, which are referred to as open-ended strip lines, has a width $W_2$ which is narrower than the width $W_1$ of the strip line 22 positioned at the center. Namely, the line impedance, expressed as $Z_2$, of each of the open-ended strip lines 21 and 23 is selected to be higher than the impedance $Z_1$ of the center strip line 22. The strip-line resonator of this structure is referred to as a stepped impedance resonator (SIR).

Generally-speaking, it is known that in a double-open-ended line, the voltage is maximum at the open-ended portions, while the current is maximum at the midway point or the center of the line. Since the current is defined by the resistance loss of the line, the electrical power loss can be reduced if the resistance at the center of the line, at which the current is great, is lowered. Therefore, the present inventors have made the width $W_1$ of the center strip line 22 wider than the width $W_2$ of the open-ended strip lines 21 and 23. In other words, the impedance at the center strip line 22 has been lowered to decrease the loss which occurs there.

On the other hand, the impedance $Z_2$ of each of the open-ended strip lines 21 and 23 is preferably set to 50 ohms to facilitate external couplings. Accordingly, the impedance $Z_1$ at the center strip line 22 is preferably set to a value below 50 ohms in practice.

In the actual designing of the strip-line resonator according to the present invention, a symmetrical structure as shown in FIG. 5A may be adopted. Namely, the impedances $Z_2$ at both open-ended strip lines 21 and 23 are selected to be equal to each other, and the length $l_2$ thereof are equal to each other. The condition of resonance is given by:

$$\tan(\beta l_2)\cdot\tan(\beta l_1/2)=Z_2/Z_1=K$$

wherein $\beta$ is a phase constant, and

K is the impedance ratio expressed by $Z_2/Z_1$

In the above, if $l_1=2l_2$, the above equation is further simplified, providing advantages in designing a strip-line resonator. Namely, when the above relation is satisfied, the condition of resonance is given by:

$$l_2=\frac{l_1}{2}=\frac{1}{\beta}\cdot\tan^{-1}(\sqrt{K})$$

Assuming that the lowest spurious resonance frequency and the fundamental frequency are respectively expressed in terms of $f_{s1}$ and $f_0$, the following relation is obtained:

$$f_{s1}=f_0\cdot\pi/(2\tan^{-1}\sqrt{K})$$

In the above, $K>1$ because $Z_2>Z_1$. As a result, the following relationship is obtained:

$$\frac{\pi}{2} > \tan^{-1}\sqrt{K} > \frac{\pi}{4}$$

From this relationship the following formula results:

$$f_0 < f_{s1} < 2f_0$$

The above formula means that the lowest spurious resonance frequency $f_{s1}$ does not equal the integral multiples of the fundamental resonance frequency $f_0$. Therefore, when the strip-line resonator according to the present invention is used in a filtering circuit, such as an output filter or the like, the filter has a desirable suppression characteristic with respect to harmonics of the fundamental frequency $f_0$.

Figure 6:
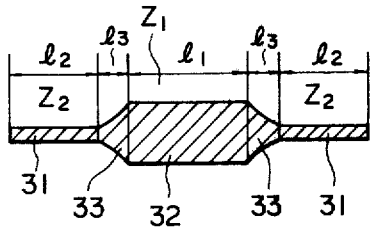
FIG. 6 is a schematic top plan view of a strip-line pattern of another embodiment of the strip-line resonator according to the present invention.

FIG. 6 shows another embodiment of the strip-line resonator according to the present invention. In FIG. 6, only a strip line conductor portion is shown, and the illustrated strip line conductor portion is attached to a substrate (not shown) in the same manner as in the above-described embodiment.

This embodiment is a modification of the above-mentioned embodiment. Namely, the shoulder portions at both ends of the center strip line 22 of FIG. 5A are rounded, curved or sloped as shown in FIG. 6. In other words, both edge portions of the center strip line 22 of FIG. 5A are tapered to reduce the width until the width of each edge portion becomes equal to the width $W_2$ of the open-ended strip lines 21 and 23 of FIG. 5A.

In FIG. 6, open-ended strip lines are designated by a reference numeral 31, and the center strip line is designated by 32. A reference numeral 33 indicates the above-mentioned tapered portions connecting each end of the center strip line 32 to each of the open-ended strip lines 31. The form of tapering may be of an exponential curve or a straight line. The longitudinal length of each of the above-mentioned tapered portions 31 is expressed in terms of $l_3$, and this length $l_3$ is preferably designed to be much shorter than the length $l_1$ of the center strip line 32 and the length 2 of each of the open-ended strip lines 31.

The above-mentioned embodiment of FIG. 6 has an advantage that stray capacitances at the connecting portions between the edges of the center strip line 32 and the open-ended strip lines 31 can be reduced compared to the embodiment of FIGS. 5A and 5B in which the width stepwisely changes at the connecting portions. Such stray capacitances may exist when the difference between the width $W_1$ and the other width $W_2$ is great in a resonator having the structure of FIG. 5A. Stray capacitances may deteriorate the characteristic of a resonator. Therefore, when the difference between the widths $W_1$ and $W_2$ is great, the arrangement of the embodiment of FIG. 6 may be used in place of the embodiment of FIGS. 5A and 5B.

Turning back to FIG. 5A, let the electrical length of the center strip line 22 be expressed in terms of $\theta_1$, and let the electrical length of each of the open-ended strip lines 21 and 23 be expressed in terms of $\theta_2$. Then the admittance Yi of the resonator viewed from one open end is given by:

$$Yi = j\frac{1}{Z_2}\cdot\frac{2(K\tan\theta_1 + \tan\theta_2)(K - \tan\theta_1\cdot\tan\theta_2)}{K(1-\tan^2\theta_1)(1-\tan^2\theta_2) - 2(1+K^2)\tan\theta_l\cdot\tan\theta_2}$$

In the above, it is preferable to select $\theta_1$ and $\theta_2$ so that $\theta_1=\theta_2=\theta$ for simplifying the formula used in designing and for easy designing. If the electrical lengths $\theta_1$ and $\theta_2$ are selected as in the above, the admittance Yi is given by:

$$Yi = j\frac{1}{Z_2}\cdot\frac{2(1+K)(K-\tan^2\theta)\tan\theta}{K - 2(1+K+K^2)\tan^2\theta + K\tan^4\theta}$$

Since the condition of resonance is satisfied when Yi=0, values of $\theta$ which satisfy the condition of resonance are placed in order from the smallest $\theta a$ to the largest $\theta b$ as follows:

$$\theta a = \tan^{-1}\sqrt{K}$$

$$\theta b = \frac{\pi}{2}$$

$$\theta c = \tan^{-1}(-\sqrt{K}) = \pi - \theta_a$$

In the above, $\theta a$ corresponds to the fundamental resonance frequency $f_0$, while $\theta_1$ and $\theta_2$ respectively correspond to spurious resonance frequencies $f_{s1}$ and $f_{s2}$.

As $\theta$ is in proportion to the frequency, $f_{s1}$ and $f_{s2}$ are defined as follows:

$$\frac{f_{s1}}{f_0} = \frac{\theta_b}{\theta_a} = \frac{\pi}{2\tan^{-1}\sqrt{K}}$$

$$\frac{f_{s2}}{f_0} = \frac{\theta_c}{\theta_a} = \frac{\pi - \theta_a}{\theta_a} = 2\left(\frac{f_{s1}}{f_0}\right) - 1$$

From the above analysis it will be understood that the condition of resonance is defined by the impedance ratio K, and spurious resonance frequencies vary in accordance with the value of K.

Figure 7:
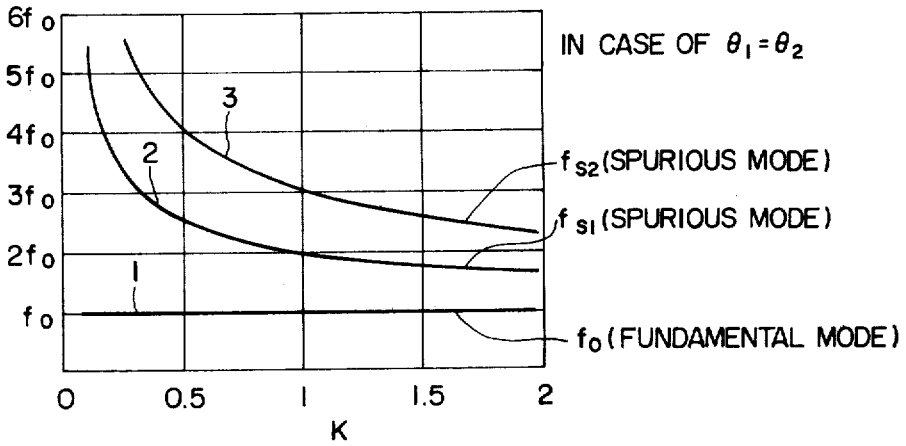
FIG. 7 is a graphical representation showing the relationship between the impedance ratios of the resonator of FIGS. 5A and 5b and resonance frequencies.

FIG. 7 is a praphical representation showing the resonance frequencies with respect to the values of K. It is shown in the graph that the resonance frequencies are $f_0$, $2f_0=f_{s1}$, and $3f_0=f_{s2}$ if K=1, i.e. the width of the resonator strip line conductor is constant or uniform. If K=0.5, the resonance frequencies are $f_0$, $2.55f_0=f_{s1}$, and $4.10f_0$, and if K=1.5, the resonance frequencies are $f_0$, $1.7f_0=f_{s1}$ and $2.5f_0=f_{s2}$. It will be understood from the graph of FIG. 7, that by setting K to a value which is either greater than 1 or less than 1 spurious resonance frequencies do not equal the integral multiples of the fundamental resonance frequency $f_0$. However, since a strip-line resonator having a characteristic of K<1 has a drawback as described herein before, a strip-line resonator having a characteristic of K<1 as described with reference to FIG. 5A, FIG. 5B and FIG. 6 is used in accordance with the present invention.

Figure 8:
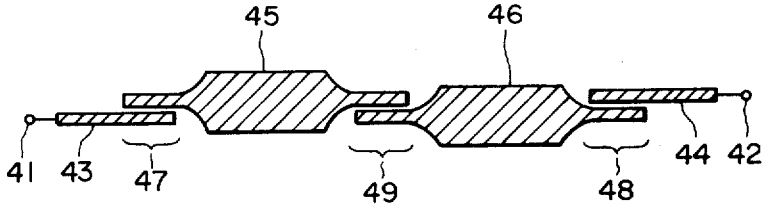
FIG. 8 is a schematic top plan view of a strip-line pattern of an embodiment of the band pass filter having two strip-line resonators of the structure of FIG. 6.

Reference is now made to FIG. 8 which shows a schematic top plan view of a band pass filter utilizing the above-mentioned embodiment of the resonator of FIG. 6. The band pass filter of FIG. 8 is a two-stage band pass filter, and comprises an input coupling line 43, an output coupling line 44, a first strip-line resonator 45, and a second strip-line resonator 46. The input coupling line 43 is connected at one end thereof to an input terminal 41 for receiving an input signal, and is electromagnetically coupled to one end of the first strip-line resonator 45 at the other end portion. The coupling portion between the input coupling line 43 and the first stripline resonator 45 is designated by a reference numeral 47. The other portion of the first strip-line resonator 45 is electromagnetically coupled at an interstage coupling portion 49 to one end portion of the second strip-line resonator 46, the other end portion of which is electromagnetically coupled at a coupling portion 48 to one end portion of the output coupling line 44. The other end of the output coupling line 44 is connected to an output terminal 42. The band pass filter having the above-described structure is suitable for a narrow band filter, and the electrical power loss of this band pass filter is considerably reduced when compared to a conventional filter having parallel coupled half wave resonators.

Figure 9:
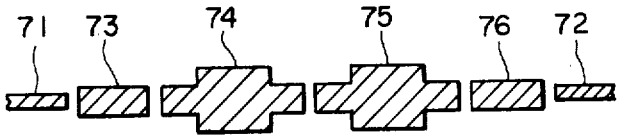
FIG. 9 is a schematic top plan view of a strip-line pattern of another embodiment of the band pass filter having four resonators, according to the present invention.

FIG. 9 illustrates another embodiment of a band pass filter according to the present invention. The band pass filter of FIG. 9 is of a four-stage capacity-coupling type. Reference numerals 71 and 72 respectively indicate input and output coupling lines. Between these input and output coupling lines are arranged a first uniform-width strip-line resonator 73, a first stepped impedance strip-line resonator 74, a second stepped impedance strip-line resonator 75, and a second uniform-width strip-line resonator 76. These four strip-line resonators 73 to 76 are electromagnetically coupled in series.

The length 4 of each of the uniform-width strip-line resonators 73 and 76 is selected to be shorter than the length $l_5$ of each of the stepped impedence strip-line resonators 74 and 75. The impedance ratio K of the first stepped impedance strip-line resonator 74 may be equal to or different from the impedance ratio K of the second stepped impedance strip-line resonator 75. Since the impedance ratio of both of the uniform-width strip-line resonators 73 and 76 equals 1, while the impedance ratio of both of the stepped impedance strip-line resonators 74 and 75 is greater than 1, the resonance frequencies of all resonators 73 to 76 agree at only the fundamental resonance frequency $f_0$.

Figure 1A:
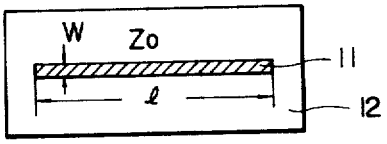
FIG. 1A PRIOR ART
FIGS. 1A and 1B are a top plan view and a cross-sectional view of a conventional strip-line resonator.
Figure 1B:
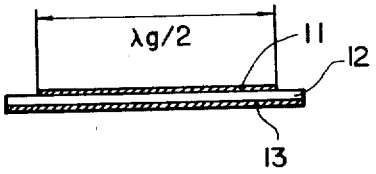
FIG. 1B PRIOR ART
Figure 2:
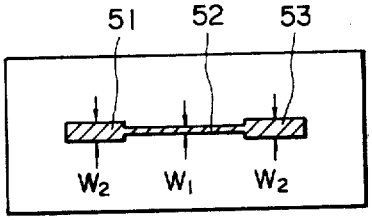
FIG. 2 PRIOR ART
FIG. 2 is a top plan view of another conventional strip-line resonator.
Figure 3:
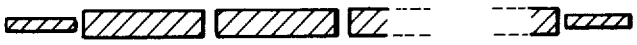
FIG. 3 PRIOR ART
FIG. 3 is a top plan view of a strip-line pattern of a conventional band pass filter.
Figure 4:
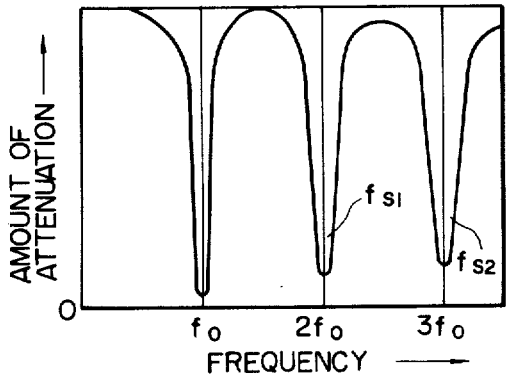
FIG. 4 PRIOR ART
FIG. 4 is a graphical representation showing the attenuation characteristic of the band pass filter of FIG. 2.
Figure 10:
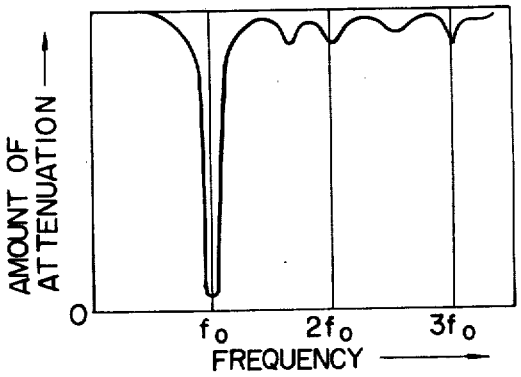
FIG. 10 is a graphical representation showing the attenuation characteristic of the band pass filter of FIG. 9.

The attenuating characteristic of the band pass filter of FIG. 9 is shown in a graph of FIG. 10. From the comparison between attenuating characteristic of FIG. 10 and of FIG. 4, it will be recognized that the degree of attenuation at integral multiples of the fundamental resonance frequency $f_0$ has been remarkably improved. Since the attenuation or response characteristic of the band pass filter according to the present invention has been greatly enhanced as described in the above, the rejection band width characteristic has also been considerably improved.

Figure 11:
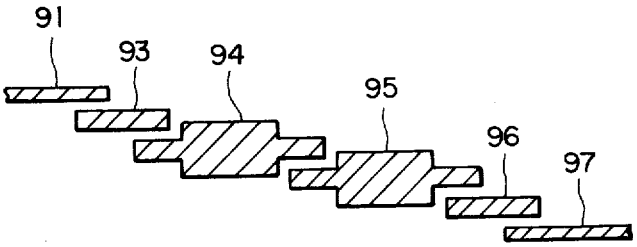
FIG. 11 is a schematic top plan view of a strip-line pattern of another embodiment which is a variation of the band pass filter of FIG. 9.

FIG. 11 illustrates another embodiment of a band pass filter according to the present invention. The band pass filter of FIG. 11 differs from the above-described embodiment of FIG. 9 in that coupling between elements is performed by means of distributed capacity-coupling rather than by a simple capacity-coupling between tip portions of each strip-line resonators. Namely, when the transmission band width is wide and the degree of coupling is high, the capacitance at each gap defined between the tip portions of resonators is too small to form a band pass filter. In this case the embodiment of FIG. 11 is desirable.

In detail, the band pass filter of FIG. 11 comprises input and output coupling lines 91 and 97, first and second uniform-width strip-line resonators 93 and 96, and first and second stepped impedance strip-line resonators 94 and 95 which respectively correspond to the elements 71 to 72 of FIG. 9. The above-mentioned six elements 91 to 97 are stepwisely arranged in parallel in such a manner that each element has one or two ends overlapped with the end portion of an adjacent element.

Figure 12:
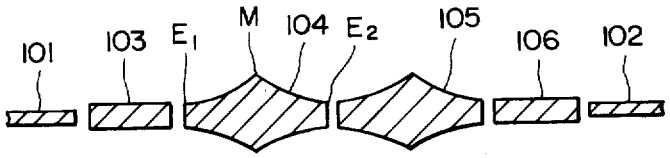
FIG. 12 is a schematic top plan view of a strip-line pattern of another embodiment which is also a variation of the band pass filter of FIG. 9.

FIG. 12 shows another embodiment which corresponds to a variation of the embodiment of FIG. 9. This embodiment is the same in construction as that of FIG. 9 except that the stepped impedance strip-line resonators 74 and 75 of FIG. 9 are respectively replaced by tapered strip-line resonators 104 and 105. The band pass filter of FIG. 12 comprises, therefore, input and output coupling lines 101 and 102, first and second uniform-width strip-line resonators 103 and 106, and the above-mentioned tapered strip-line resonators 104 and 105.

The tapered strip-line resonators 104 and 105 are different from the aforementioned strip-line resonator having tapered portions 33 (see FIG. 6). Although the resonator of FIG. 6 has a tapered portion 33 between the center strip-line 32 and each open-ended strip-line 31, the tapered strip-line resonators 104 or 105 does not have a constant-width portion. In detail, each of the resonators 104 and 105 has a first edge portion $E_1$, and the width of the strip line 104 or 105 increases exponentially toward the midway point M of the strip line 104 or 105. The width then exponentially decreases from the midway point M toward the other edge portion $E_2$. The strip-line resonator 104 or 105 having the above-mentioned structure can also be designed to have spurious resonance frequencies $f_{s1}$, $f_{s2}$ . . . at other than integral multiples of the fundamental resonance frequency $f_0$.

Although in the above-described embodiments of FIG. 8 to FIG. 12, the number of resonators is either four or six, the number of resonators can be changed if desired. Furthermore, the value of the impedance ratio K of each resonator can be changed in various ways. Namely, if there are four resonators as in FIG. 9, 11 or 12, the values of K of all four resonators may each be set to a different value from one another. Alternatively, the value of K of one resonator may be different from the remaining three resonators which all have the same K. The shape of each resonator is not limited to those described and shown in the drawings, and therefore, strip-line resonators having other shapes may be combined to form a band pass filter.

The above-described embodiments of the strip-line resonator and the band pass filter according to the present invention are just examples, and therefore, it will be understood by those skilled in the art that many modifications and variations may be made without departing from the spirit of the present invention.

What is claimed is:

1. A strip-line resonator comprising:

(a) a substrate made of a dielectric;

(b) a ground-plane conductor attached to one surface of said substrate; and (c) a strip-line conductor placed on the other surface of said substrate, said strip-line conductor being formed of first and second open-ended conductors and a center conductor interposed between said first and second open-ended conductors, the impedance of said center conductor being lower than the impedances of said first and second open-ended conductors.

2. A strip-line resonator as claimed in claim 1, wherein said center conductor is connected, at both ends thereof, to said first and second open-ended conductors in such a manner that the width of said strip-line conductor stepwisely varies at said both ends of said center conductor.

3. A strip-line resonator as claimed in claim 1, wherein said center conductor is connected, at both ends thereof, to said first and second open-ended conductors in such a manner that the width of said strip-line conductor continuously varies at said both ends of said center condutor.

4. A strip-line resonator as claimed in claim 3, wherein said center conductor is connected to said first and second open-ended conductors in such a manner that the width of said strip-line conductor varies exponentially at said both ends of said center conductor.

5. A strip-line resonator as claimed in claim 3, wherein said center conductor is connected to said first and second open-ended conductors in such a manner that the width of said strip-line conductor varies linearly at said both ends of said center conductor.

6. A strip-line resonator as claimed in claim 1, wherein the longitudinal length of said first open-ended conductor equals that of said second open-ended conductor.

7. A strip-line resonator as claimed in claim 1, wherein the width of said first open-ended conductor equals that of said second open-ended conductor.

8. A strip-line resonator as claimed in claim 1, wherein said strip-line conductor has a symmetrical structure with respect to a center line which passes through a midway point of said center conductor.

9. A strip-line resonator as claimed in claim 1, wherein the longitudinal length of said center conductor is shorter than the lengths of said first and second open-ended conductors.

10. A strip-line resonator as claimed in claim 1, wherein the longitudinal length of said first open-ended conductor equals the longitudinal length of said second open-ended conductor, and wherein the longitudinal length of said center conductor equals the sum of said lengths of said first and second open-ended conductors.

11. A strip-line resonator as claimed in claim 3, wherein the longitudinal length of each of the continuously varying width portions is relatively shorter than the longitudinal length of said center conductor.

12. A strip-line resonator as claimed in claim 1, wherein the impedance of each of said first and second open-ended conductors equals 50 ohms.

13. A band pass filter comprising a plurality of resonators in which at least one of said plurality of resonators is formed of a line of uniform-width and at least one other of said plurality of resonators is formed of a line having narrow and wide portions so that at least one of said resonators shows spurious resonance frequencies which are different from those of remaining resonators.

14. A band pass filter as claimed in claim 13, wherein said plurality of resonators are of TEM mode transmission line type.

15. A band pass filter as claimed in claim 13, wherein said line having narrow and wide portions comprises stepped portions at which the width of said line stepwisely varies.

16. A band pass filter as claimed in claim 13, wherein said line having narrow and wide portions comprises tapered portions at which the width thereof continuously varies.

17. A band pass filter as claimed in claim 16, wherein said width of said continuously varying line varies exponentially at said tapered portions.

18. A band pass filter as claimed in claim 16, wherein said continuously varying width of said line varies linearly at said tapered portions.

* * * * *